US008737066B1

(12) United States Patent
Block

(10) Patent No.: US 8,737,066 B1
(45) Date of Patent: May 27, 2014

(54) GRIPPING DEVICE AND METHOD OF USE

(75) Inventor: Aaron Block, Lake Forest, CA (US)

(73) Assignee: Mobile Innovations, Inc., Lake Forest, CA (US)

( * ) Notice: Subject to any disclaimer, the term of this patent is extended or adjusted under 35 U.S.C. 154(b) by 106 days.

(21) Appl. No.: 13/491,371

(22) Filed: Jun. 7, 2012

Related U.S. Application Data

(60) Provisional application No. 61/496,510, filed on Jun. 13, 2011.

(51) Int. Cl.
*A41D 19/00* (2006.01)
*A61C 19/00* (2006.01)

(52) U.S. Cl.
USPC ..... 361/679.59; 224/217

(58) Field of Classification Search
None
See application file for complete search history.

(56) References Cited

U.S. PATENT DOCUMENTS

| | | | | |
|---|---|---|---|---|
| 6,182,878 | B1 * | 2/2001 | Racca | 224/605 |
| 6,726,070 | B2 * | 4/2004 | Lautner | 224/221 |
| 7,844,310 | B2 * | 11/2010 | Anderson | 455/575.1 |
| 7,969,732 | B1 * | 6/2011 | Noble | 361/679.56 |
| 8,186,642 | B2 * | 5/2012 | Weiss-Vons | 248/683 |
| 2002/0166212 | A1 * | 11/2002 | Pratl | 24/3.2 |
| 2003/0213822 | A1 * | 11/2003 | Lautner | 224/221 |
| 2004/0226973 | A1 * | 11/2004 | Kao | 224/218 |
| 2005/0205623 | A1 * | 9/2005 | Buntain | 224/217 |
| 2007/0008692 | A1 * | 1/2007 | Staples | 361/683 |
| 2007/0181620 | A1 * | 8/2007 | Carver | 224/217 |
| 2008/0043416 | A1 * | 2/2008 | Narayan | 361/683 |
| 2008/0083797 | A1 * | 4/2008 | Myers | 224/217 |
| 2009/0219677 | A1 * | 9/2009 | Mori et al. | 361/679.03 |
| 2009/0283559 | A1 * | 11/2009 | Foggiato | 224/217 |
| 2011/0084081 | A1 * | 4/2011 | Chung et al. | 220/628 |
| 2011/0266316 | A1 * | 11/2011 | Ghalib et al. | 224/217 |
| 2011/0279959 | A1 * | 11/2011 | Lopez | 361/679.03 |
| 2011/0309117 | A1 * | 12/2011 | Roberts | 224/217 |
| 2012/0019016 | A1 * | 1/2012 | Brisbin | 294/137 |
| 2012/0031937 | A1 * | 2/2012 | Baker | 224/217 |
| 2012/0037771 | A1 * | 2/2012 | Kitchen | 248/223.41 |
| 2012/0042476 | A1 * | 2/2012 | Karmatz | 16/421 |
| 2012/0104185 | A1 * | 5/2012 | Carroll | 248/27.1 |
| 2012/0170211 | A1 * | 7/2012 | Waller et al. | 361/679.56 |
| 2012/0228346 | A1 * | 9/2012 | Huang | 224/218 |
| 2012/0267402 | A1 * | 10/2012 | Beatty | 224/218 |

OTHER PUBLICATIONS

Author: Unknown; www.flygrip.com; Date: Unknown.

* cited by examiner

*Primary Examiner* — Adrian S Wilson
(74) *Attorney, Agent, or Firm* — Eric Karich

(57) ABSTRACT

A gripping device has a base element, a gripping element, and a flexible cord. The base element is adapted to be attached to the portable electronic device, and the gripping element is shaped to be gripped by the user. The flexible cord is connected to the base element and the gripping element, to be inserted between two of the user's fingers. As a result, the gripping device enables the user to hold the portable electronic device via the gripping device using just two fingers.

11 Claims, 2 Drawing Sheets

GRIPPING DEVICE AND METHOD OF USE

CROSS-REFERENCE TO RELATED APPLICATIONS

This application for a utility patent claims the benefit of U.S. Provisional Application No. 61/496,510 filed Jun. 13, 2011.

BACKGROUND OF THE INVENTION

1. Field of the Invention

This invention relates generally to gripping devices, and more particularly to a gripping device used to hold a portable electronic device with just two fingers.

2. Description of Related Art

The following art defines the present state of this field: A device currently being sold under the name "FlyGrip" allows a user to hold a mobile phone with one hand, in a manner somewhat similar to the present invention. The FlyGrip product includes a base that is bonded to the mobile phone and a gripping feature; however, the gripping feature of the FlyGrip product is connected to the base with a rigid component that is hingably attached to both the base and the gripping feature. While the rigid connector serves a dual function of also providing a stand, it has an uncomfortable feel, it limits the ability of the mobile phone to twist in the user's fingers, and it is too bulky.

The prior art teaches a rigid gripping device for use with portable electronic devices. However, the prior art does not teach a gripping device that utilizes a flexible cord between the user's fingers to hold the portable electronic device in place and prevent the device from sliding or falling out of the user's hand. The present invention fulfills these needs and provides further related advantages as described in the following summary.

SUMMARY OF THE INVENTION

The present invention teaches certain benefits in construction and use which give rise to the objectives described below.

The present invention provides a gripping device for assisting a user in gripping a portable electronic device. The gripping device includes a base element, a gripping element, and a flexible cord. The base element is adapted to be attached to the portable electronic device, and the gripping element is shaped to be gripped by the user. The flexible cord is connected to the base element and the gripping element, and functions to hold the gripping element against two of the user's fingers.

A primary objective of the present invention is to provide a gripping device having advantages not taught by the prior art.

Another objective is to provide a gripping device that allows a user to hold a portable electronic device with just two fingers.

Another objective is to provide a gripping device that may be adjusted according to the size of the user's fingers in order to provide both a comfortable and secure grip of a portable electronic device.

A further objective is to provide a gripping device that may be personalized in both color and form, as desired by the user.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention, a gripping device 10 for assisting a user in gripping a portable electronic device 12. The gripping device 10 may be operably attached to a portable electronic device 12, such that a user may operate the portable electronic device 12 one-handed while keeping his or her thumb free to press buttons and otherwise operate the portable electronic device 12. Although a mobile phone is illustrated in the following figures, the portable electronic device 12 may be any form of portable electronic device 12 (e.g., a tablet computer such as an iPad®, portable gaming devices, personal digital assistants (PDA), audio devices, iPods®, and other handheld electronic devices).

Figure 1:
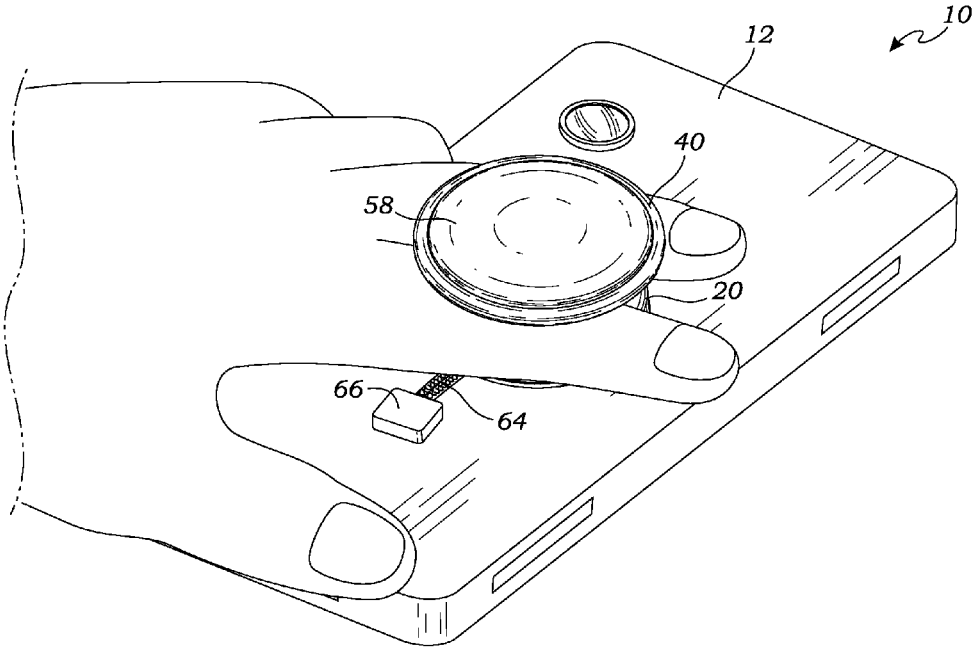
FIG. 1 is a perspective view of a gripping device according to one embodiment of the present invention, illustrating the gripping device in an open position so that two fingers of a user may be used to hold a portable electronic device.
Figure 2:
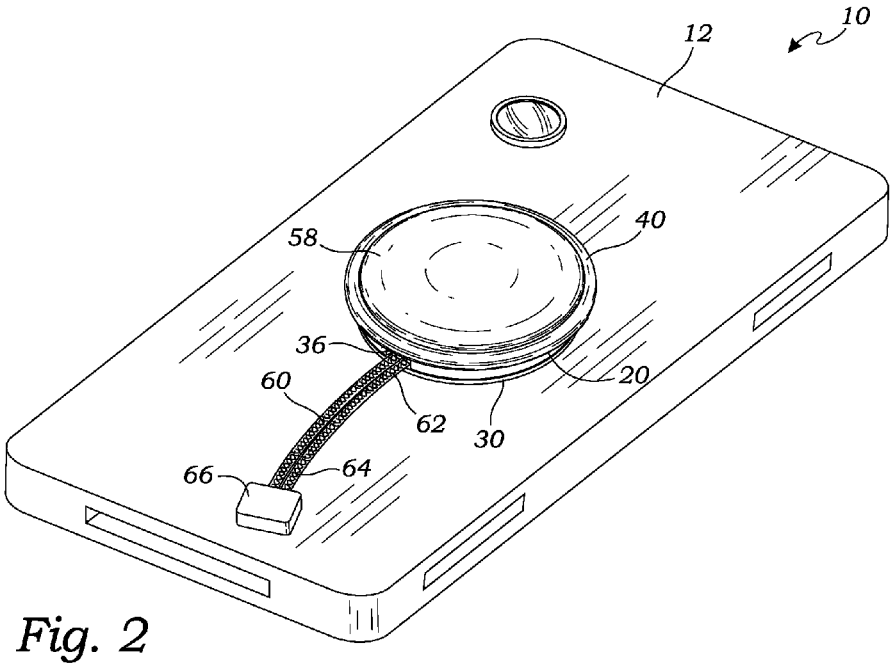
FIG. 2 is a perspective view of the gripping device in a retracted position, so that the gripping device is maintained flush against the portable electronic device.
Figure 3:
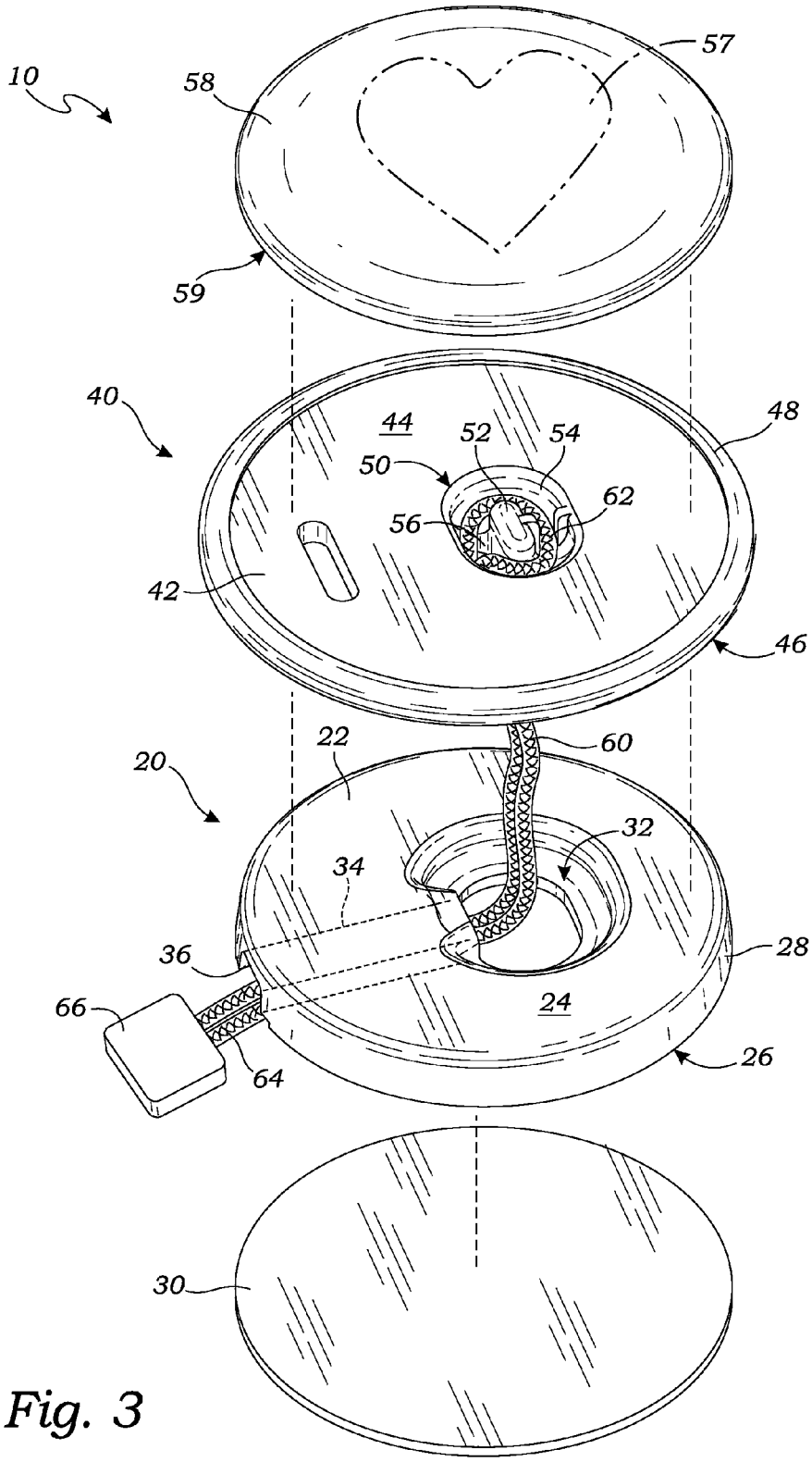
FIG. 3 is an exploded perspective view of the gripping device.

FIG. 1 is a perspective view of a gripping device 10 according to one embodiment of the present invention, illustrating the gripping device 10 in an open position so that two fingers of a user's hand may be used to hold a portable electronic device 12. FIG. 2 is a perspective view of the gripping device 10 in a retracted position, so that the gripping device 10 is maintained flush against the portable electronic device 12. FIG. 3 is an exploded perspective view of the gripping device 10. As shown in FIGS. 1-3, the gripping device 10 includes a base element 20, a gripping element 40, and a flexible cord 60.

As illustrated in FIGS. 1-3, the base element 20 is adapted to be attached to the portable electronic device 12. As best illustrated in FIG. 3, the base element 20 has a planar base body 22 that includes a top surface 24 and a bottom surface 26 that extend to a perimeter 28. The bottom surface 26 of the base element 20 may include an adhesive layer 30 for bonding the base element 20 onto the portable electronic device 12. While an adhesive is used in the present embodiment, the base element 20 may be attached using alternative means. In one alternative embodiment, the base element 20 attached to or is integrally formed with a protective frame (not illustrated) or a skin (not illustrated) such as is already common in the art. Those skilled in the art may devise alternative methods of attaching or otherwise associating the base element 20 with the portable electronic device 12, and such alternatives should be considered within the scope of the present invention.

As illustrated in FIG. 3, the base element 20 may further include a cord-receiving recess 32, a slot 34, and a side aperture 36. The cord-receiving recess 32 of this embodiment is shaped to receive the flexible cord 60, and may be formed by a recess partially through the base element 20, or an aperture that extends entirely through the base element 20, as long as it functions to receive the flexible cord 60, as described herein. The slot 34 extends from the cord-receiving recess 32 to the side aperture 36 in the perimeter 28 of the planar base body 22, so that the flexible cord 60 may exit the side aperture 36, as discussed in greater detail below.

The gripping element 40 illustrated in FIGS. 1-3 is shaped to be gripped by the user. As best illustrated in FIG. 3, the gripping element 40 includes a planar gripping body 42 having a top surface 44 and a bottom surface 46 that extend to a perimeter 48. The gripping element 40 may be generally disk-shaped, although this generally shape may include a wide variety of shapes or designs, and may include various decorative features, so as to be attractive to the user.

As illustrated in FIGS. 1-3, the gripping element 40 may further include a cord attachment point 50 that may be affixed to the flexible cord 60. In the present embodiment, the cord attachment point 50 includes a center post 52 surrounded by an annular depression 54 having a cord hole 56. The flexible cord 60 of this embodiment forms a loop around the center post 52 while nested within the annular depression 54, and escapes through the cord hole 56, as discussed in greater detail below.

In this embodiment, best illustrated in FIG. 3, the cord attachment point 50 nests within the cord-receiving recess 32 of the base element 20, so that the gripping element 40 may have a low profile on the portable electronic device 12. Furthermore, a cover layer 58 may be bonded to the top surface 44 of the gripping element 40 to cover the cord attachment point 50. The cover layer 58 may also for a decorative cover, which may be interchangeable if desired. In one embodiment, the cover layer 58 is transparent to protect decorative indicia 57, which may be printed on either the gripping element 40 or an underside 59 of the cover layer 58. While FIGS. 1-3 illustrate one embodiment of the gripping element 40, those skilled in the art may devise alternative embodiments that function as described herein, and such alternatives should be considered within the scope of the present invention.

As illustrated in FIG. 1, the flexible cord 60 enables the user to easily and securely hold the portable electronic device 12 via the gripping device 10 using, for example, just two fingers, leaving the user free to operate the device 12 using his or her thumb. As best illustrated in FIG. 3, the flexible cord 60 may be connected to the gripping element 40 and may extend through the base element 20. Obviously, this arrangement may be reversed in another embodiment, and all of the terms discussed herein are specifically defined to include the alternative embodiment wherein this relationship is reversed, and the flexible cord 60 is attached to the base element 20 and extends through the gripping element 40

In the present embodiment, as best illustrated in FIG. 3, the flexible cord 60 is attached at one end 62 to the cord attachment point 50 of the gripping element 40, and extends into the cord-receiving recess 32 and out the slot 34 of the base element 20 to a terminal end 64. The terminal end 64 of the flexible cord 60 may include a pull bead 66 that has a diameter that is larger than the diameter of the side aperture 36, as illustrated in FIGS. 1-3. The pull bead 66 may be used to vary the width of the gap between the base element 20 and the gripping element 40. The term "pull bead 66" is hereby defined to include any form of bulb, handle, bead, or similar body that is attached to the terminal end 64 of the flexible cord 60 to facilitate pulling the flexible cord 60.

In one embodiment, the flexible cord 60 may be elastic, to facilitate use of the gripping device 10 and to provide a more secure grip to the user. However, in alternative embodiments, the flexible cord 60 may be inelastic.

As illustrated in FIG. 1, in the open position the gap between the base element 20 and the gripping element 40 is great enough for the user to insert his or her fingers therebetween, although the particular size of the gap may vary depending upon the size of the user's fingers, thus enabling the gripping devise to be customized to all users, regardless of size or age. As illustrated in FIG. 2, in the refracted position the gripping element 40 has been pulled flush against the base element 20 and/or the portable electronic device 12, so that when the gripping device 10 is not in use, it does not unduly protrude and interfere with the transport and storage of the portable electronic device 12.

The invention also includes a method of using the gripping element 40s, as described above, for holding a portable electronic device 12 using two fingers. In this method, the base element 20 of the gripping device 10 is attached to the portable electronic device 12 (e.g., via the adhesive layer 30, or other method). The user may then pull the gripping element 40 away from the portable electronic device 12 until there is enough space therebetween to insert two fingers between the base element 20 and the gripping element 40.

In the open position, with one finger on either side of the flexible cord 60, as illustrated in FIG. 1, the user is able to easily hold and operate the portable electronic device 12 with just one hand. As a result, the user's thumb is available to press buttons without being hindered by the portable electronic device 12 while his or her other hand is free to take notes, tend to a child, or hold a cup of coffee, etc.

When the user is done using the gripping device 10, he or she may simply pull the terminal end 64 of the flexible cord 60 (e.g., by the pull bead 66) to draw the gripping element 40 to the retracted position, illustrated in FIG. 2, so that the gripping element 40 is flush against the base element 20 and/or the portable electronic device 12.

As used in this application, the words "a," "an," and "one" are defined to include one or more of the referenced item unless specifically stated otherwise. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application.

What is claimed is:

1. A gripping device for assisting a user in gripping a portable electronic device, the gripping device comprising:

a base element adapted to be attached to the portable electronic device;

a gripping element shaped to be gripped by the user;

a flexible cord connecting the base element and the gripping element;

wherein the base element has a planar base body having a top surface and a bottom surface that extend to a perimeter; an adhesive layer covering the bottom surface for bonding the base element onto the portable electronic device; a cord-receiving recess in the planar base body; and a slot extending from the cord-receiving recess to a side aperture in the perimeter of the planar base body;

wherein the gripping element includes a cord attachment point, and wherein the flexible cord is attached to the cord attachment point and extends into the cord-receiving recess and out the slot to a terminal end.

2. The gripping device of claim 1, wherein the terminal end of the flexible cord includes a pull bead that has a diameter that is larger than the diameter of the side aperture.

3. The gripping device of claim 1, wherein the cord attachment point of the gripping element nests within the cord-receiving recess of the base element.

4. The gripping device of claim 1, wherein the flexible cord is elastic.

5. The gripping device of claim 1, wherein the gripping element includes a planar gripping body having a top surface and a bottom surface that extend to a perimeter, and further includes a cover layer that is attached to the top surface of the gripping element.

6. The gripping device of claim 5, wherein the cover layer is transparent.

7. The gripping device of claim 6, wherein the cover layer includes a decorative indicia printed on an underside of the cover layer.

8. A gripping device for assisting a user in gripping a portable electronic device, the gripping device comprising:

a base element having a planar base body having a bottom surface and a top surface that extend to a perimeter; an adhesive layer covering the bottom surface of the base element for bonding the base element onto the portable electronic device; a cord-receiving recess in the planar base body; and a slot extending from the cord-receiving recess to a side aperture in the perimeter of the planar base body;

a gripping element having a cord attachment point; and a flexible cord attached to the cord attachment point of the gripping element and extending into the cord-receiving recess and out of the slot to a terminal end.

9. The gripping device of claim 8, wherein the terminal end of the flexible cord includes a pull bead that has a diameter that is larger than the diameter of the side aperture.

10. The gripping device of claim 8, wherein the cord attachment point of the gripping element nests within the cord-receiving recess of the base element.

11. A method for holding a portable electronic device using two fingers, the method comprising the steps of:

providing a gripping device comprising:

a base element;

a gripping element;

a flexible cord connecting the base element and the gripping element;

wherein the base element has a planar base body having a top surface and a bottom surface that extend to a perimeter; an adhesive layer covering the bottom surface for bonding the base element onto the portable electronic device; a cord-receiving recess in the planar base body; and a slot extending from the cord-receiving recess to a side aperture in the perimeter of the planar base body; and wherein the gripping element includes a cord attachment point;

attaching the base element to the portable electronic device such that the flexible cord extends into the cord-receiving recess and out the slot to a terminal end; and inserting the two fingers between the base element and the gripping element, one of the fingers on either side of the flexible cord, so that the flexible cord holds the gripping element against the two fingers and enables the user to hold the portable electronic device via the gripping device using just the two fingers.

* * * * *